US008302307B2

(12) United States Patent
Thors et al.

(10) Patent No.: US 8,302,307 B2
(45) Date of Patent: Nov. 6, 2012

(54) METHOD OF FORMING PROTRUSIONS ON THE INNER SURFACE OF A TUBE

(75) Inventors: Petur Thors, Decatur, AL (US); Nikolai Zoubkov, Moscow (RU)

(73) Assignee: Wolverine Tube, Inc., Huntsville, AL (US)

( * ) Notice: Subject to any disclaimer, the term of this patent is extended or adjusted under 35 U.S.C. 154(b) by 0 days.

(21) Appl. No.: 12/622,487

(22) Filed: Nov. 20, 2009

(65) Prior Publication Data

US 2010/0088893 A1 Apr. 15, 2010

Related U.S. Application Data

(62) Division of application No. 11/674,334, filed on Feb. 13, 2007, now Pat. No. 7,637,012, which is a division of application No. 10/458,398, filed on Jun. 10, 2003, now abandoned.

(60) Provisional application No. 60/387,328, filed on Jun. 10, 2002.

(51) Int. Cl.
*B21D 53/06* (2006.01)
*B23P 15/26* (2006.01)

(52) U.S. Cl. ..... 29/890.05; 29/890.043; 72/325; 165/177; 165/179; 165/181

(58) Field of Classification Search ..... 29/890.049, 29/890.043, 890.05, 597; 72/325, 283, 370, 72/392; 165/133, 151, 181, 177, 179
See application file for complete search history.

(56) References Cited

U.S. PATENT DOCUMENTS

| | | | | |
|---|---|---|---|---|
| 2,314,084 | A | 3/1943 | Fried | |
| 3,202,212 | A | 8/1965 | Kritzer | |
| 3,360,040 | A | 12/1967 | Kritzer | |
| 3,454,081 | A | 7/1969 | Kun et al. | |
| 3,753,364 | A | 8/1973 | Runyan et al. | |
| 3,776,018 | A | 12/1973 | French | |
| 3,791,003 | A | 2/1974 | Pasternak | |
| 3,847,212 | A | 11/1974 | Withers, Jr. et al. | |
| 3,886,639 | A | 6/1975 | Pasternak | |
| 3,987,539 | A * | 10/1976 | Gravener | 29/597 |
| 4,166,498 | A | 9/1979 | Fujie et al. | |

(Continued)

FOREIGN PATENT DOCUMENTS

EP 0363488 4/1990

(Continued)

OTHER PUBLICATIONS

"U.S. Appl. No. 10/458,398, Amendment and Response to Office Action", May 22, 2006.

(Continued)

*Primary Examiner* — Richard Chang
(74) *Attorney, Agent, or Firm* — Kilpatrick Townsend & Stockton LLP

(57) ABSTRACT

A method of forming a plurality of protrusions on the inner surface of a tube to reduce tube side resistance and improve overall heat transfer performance. The method includes cutting through ridges on the inner surface of the tube to create ridge layers and lifting the ridge layers to form the protrusions. In this way, the protrusions are formed without removal of metal from the inner surface of the tube, thereby eliminating debris which can damage the equipment in which the tubes are used.

19 Claims, 14 Drawing Sheets

U.S. PATENT DOCUMENTS

| | | | | |
|---|---|---|---|---|
| 4,203,311 | A | | 5/1980 | O'Connor et al. |
| 4,337,826 | A | | 7/1982 | Kritzer |
| 4,561,497 | A | | 12/1985 | Nakajima et al. |
| 4,577,381 | A | | 3/1986 | Sato et al. |
| 4,602,681 | A | | 7/1986 | Daikoku et al. |
| 4,606,405 | A | | 8/1986 | Nakayama et al. |
| 4,624,122 | A | | 11/1986 | Bridier |
| 4,646,548 | A | | 3/1987 | Zimmerli et al. |
| 4,653,163 | A | | 3/1987 | Kuwahara et al. |
| 4,672,834 | A | | 6/1987 | Alberto |
| 4,678,029 | A | | 7/1987 | Sasaki et al. |
| 4,706,355 | A | | 11/1987 | Kuhns et al. |
| 4,794,984 | A | | 1/1989 | Lin |
| 4,819,525 | A | | 4/1989 | Rabe |
| 4,938,282 | A | | 7/1990 | Zohler |
| 5,052,476 | A | | 10/1991 | Sukumoda et al. |
| 5,181,810 | A | | 1/1993 | Heule |
| 5,259,448 | A | | 11/1993 | Masukawa et al. |
| 5,332,034 | A | | 7/1994 | Chiang et al. |
| 5,351,397 | A | | 10/1994 | Angeli |
| 5,458,191 | A | * | 10/1995 | Chiang et al. ..... 165/133 |
| 5,555,622 | A | | 9/1996 | Yamamoto et al. |
| 5,597,039 | A | | 1/1997 | Rieger |
| 5,655,599 | A | | 8/1997 | Kasprzyk |
| 5,669,441 | A | | 9/1997 | Spencer |
| 5,682,946 | A | | 11/1997 | Schmidt et al. |
| 5,690,167 | A | | 11/1997 | Rieger |
| 5,692,560 | A | | 12/1997 | Messant et al. |
| 5,697,430 | A | | 12/1997 | Thors et al. |
| 5,704,424 | A | | 1/1998 | Kohno et al. |
| 5,709,029 | A | | 1/1998 | Innes |
| 5,755,538 | A | | 5/1998 | Heule |
| 5,775,187 | A | | 7/1998 | Nikolai et al. |
| 5,775,411 | A | | 7/1998 | Schuez et al. |
| 5,782,121 | A | | 7/1998 | Wetzels |
| 5,791,405 | A | | 8/1998 | Takiura et al. |
| 5,803,164 | A | | 9/1998 | Schuez et al. |
| 5,803,165 | A | | 9/1998 | Shikazono et al. |
| 5,862,857 | A | | 1/1999 | Ishikawa et al. |
| 5,915,467 | A | | 6/1999 | Ishikawa et al. |
| 5,933,953 | A | | 8/1999 | Spencer et al. |
| 5,934,128 | A | | 8/1999 | Takiura et al. |
| 5,950,716 | A | | 9/1999 | Appelquist et al. |
| 5,950,718 | A | | 9/1999 | Sugitani et al. |
| 5,975,196 | A | | 11/1999 | Gaffaney et al. |
| 5,996,686 | A | | 12/1999 | Thors et al. |
| 6,000,466 | A | | 12/1999 | Aoyagi et al. |
| 6,018,963 | A | | 2/2000 | Itoh et al. |
| 6,026,892 | A | | 2/2000 | Kim et al. |
| 6,056,048 | A | | 5/2000 | Takahashi et al. |
| 6,067,712 | A | | 5/2000 | Randlett et al. |
| 6,164,370 | A | | 12/2000 | Robinson et al. |
| 6,167,950 | B1 | | 1/2001 | Gupte et al. |
| 6,173,762 | B1 | | 1/2001 | Ishida et al. |
| 6,173,763 | B1 | | 1/2001 | Sano et al. |
| 6,176,301 | B1 | | 1/2001 | Bennett et al. |
| 6,176,302 | B1 | | 1/2001 | Takahashi et al. |
| 6,182,743 | B1 | | 2/2001 | Bennett et al. |
| 6,298,909 | B1 | | 10/2001 | Fukatami et al. |
| 6,336,501 | B1 | | 1/2002 | Ishikawa et al. |
| 6,766,817 | B2 | | 7/2004 | da Silva |
| 6,918,404 | B2 | | 7/2005 | da Silva |
| 7,284,325 | B2 | | 10/2007 | Thors et al. |
| 7,311,137 | B2 | | 12/2007 | Thors et al. |
| 7,509,828 | B2 | | 3/2009 | Thors et al. |
| 7,637,012 | B2 | | 12/2009 | Thors et al. |
| 2006/0112535 | A1 | | 6/2006 | Thors et al. |
| 2006/0213346 | A1 | | 9/2006 | Thors et al. |
| 2007/0124909 | A1 | | 6/2007 | Thors et al. |
| 2007/0157456 | A1 | | 7/2007 | Thors et al. |
| 2007/0234871 | A1 | | 10/2007 | Thors et al. |

FOREIGN PATENT DOCUMENTS

| | | | |
|---|---|---|---|
| EP | 0865838 | A | 9/1998 |
| EP | 0522985 | B2 | 2/2000 |
| EP | 0845646 | B1 | 9/2001 |
| EP | 1391675 | A1 | 2/2004 |
| FR | 2268580 | A | 11/1975 |
| JP | 54-068554 | A | 6/1979 |
| JP | 54068554 | A | 6/1979 |
| JP | 5659194 | | 5/1981 |
| JP | 56059194 | A | 5/1981 |
| JP | S56-59194 | | 5/1981 |
| JP | 58070919 | | 4/1983 |
| JP | 61078942 | | 4/1986 |
| JP | 61-175486 | A | 8/1986 |
| JP | 62237295 | A | 10/1987 |
| JP | 09108759 | | 4/1997 |
| JP | 09141361 | A | 6/1997 |
| JP | 09295037 | | 11/1997 |
| JP | 10052714 | | 2/1998 |
| JP | 10103886 | | 4/1998 |
| JP | 10197184 | A | 7/1998 |
| JP | 10206061 | | 8/1998 |
| JP | 10281676 | | 10/1998 |
| JP | 11226635 | | 8/1999 |
| JP | 2000193345 | | 7/2000 |
| WO | WO-2005114086 | | 12/2005 |

OTHER PUBLICATIONS

"U.S. Appl. No. 10/458,398, Amendment and Response to Restriction Requirement", Aug. 16, 2004.
"U.S. Appl. No. 10/458,398, Amendment and Response to Restriction Requirement", Nov. 7, 2006.
"U.S. Appl. No. 10/458,398, Final Office Action", Jul. 11, 2005.
"U.S. Appl. No. 10/458,398, Non-Final Office Action", Feb. 2, 2005.
"U.S. Appl. No. 10/458,398, Non-Final Office Action", Nov. 17, 2005.
"U.S. Appl. No. 10/458,398, Requirement for Election/Restriction", Aug. 16, 2006.
"U.S. Appl. No. 10/458,398, Requirement for Election/Restriction", Jul. 14, 2004.
"U.S. Appl. No. 10/458,398, Response to Final Office Action", Sep. 14, 2005.
"U.S. Appl. No. 10/458,398, Response to Office Action", May 4, 2005.
"U.S. Appl. No. 10/972,734, Amendment and Response to Office Action", Dec. 1, 2006.
"U.S. Appl. No. 10/972,734, Amendment and Response to Office Action", Jul. 9, 2007.
"U.S. Appl. No. 10/972,734, Amendment and Response to Office Action", Jun. 5, 2006.
"U.S. Appl. No. 10/972,734, Ex Parte Quayle Action", Mar. 7, 2007.
"U.S. Appl. No. 10/972,734, Non-Final Office Action", Feb. 8, 2006.
"U.S. Appl. No. 10/972,734, Non-Final Office Action", Sep. 1, 2006.
"U.S. Appl. No. 10/972,734, Notice of Allowance", Sep. 20, 2007.
"U.S. Appl. No. 10/972,734, Requirement for Election/Restriction", Nov. 1, 2005.
"U.S. Appl. No. 10/972,734, Response to Election/Restriction Requirement", Nov. 29, 2005.
"U.S. Appl. No. 11/674,334, Amendment and Response to Office Action", Apr. 1, 2009.
"U.S. Appl. No. 11/674,334, Non-Final Office Action", Dec. 10, 2008.
"U.S. Appl. No. 11/674,334, Notice of Allowance", Aug. 11, 2009.
"U.S. Appl. No. 11/674,334, Requirement for Election/Restriction", Sep. 5, 2008.
"U.S. Appl. No. 11/674,334, Response to Election Requirement", Oct. 2, 2008.
"U.S. Appl. No. 11/759,835, Non-Final Office Action", Sep. 17, 2009.
"U.S. Appl. No. 11/759,835, Response to Office Action", Feb. 16, 2010.
Patent Abstracts of Japan, JP-02034237, Furukawa Electric Co Ltd, Published Feb. 5, 1990.
Patent Abstracts of Japan, JP-02108410, Furukawa Electric Co Ltd, Published Apr. 20, 1990.
Patent Abstracts of Japan, JP-02112822, Furukawa Electric Co Ltd, Published Apr. 25, 1990.
Patent Abstracts of Japan, JP-02133798 , Hitachi Cable Ltd, Published May 22, 1990.

Patent Abstracts of Japan, JP-03124337, Zexel Corp, Published May 27, 1991.
Patent Abstracts of Japan, JP-03268816, Matsushita Refrig Co Ltd, Published Nov. 29, 1991.
Patent Abstracts of Japan, JP-04009210, Matsushita Electric Ind Co Ltd, Published Jan. 14, 1992.
Patent Abstracts of Japan, JP-04091819, Mitsubishi Heavy Ltd, Published Mar. 25, 1992.
Patent Abstracts of Japan, JP-04151473, Hitachi Zosen Crop, Published May 25, 1992.
Patent Abstracts of Japan, JP-04266418, Sumitomo Light Metal Ind Ltd, Published Sep. 22, 1992.
Patent Abstracts of Japan, JP-04319019, Kobe Steel Ltd, Published Nov. 10, 1992.
Patent Abstracts of Japan, JP-04333339, Segawa Kihachiro, Published Nov. 20, 1992.
Patent Abstracts of Japan, JP-05106990, Mitsubishi Shindoh Co., Ltd, Published Apr. 27, 1993.
Patent Abstracts of Japan, JP-05231790 Kobe Steel ltd, Published Sep. 7, 1993.
Patent Abstracts of Japan, JP-08035739, Sumitomo Light Metal Ind Ltd, Published Feb. 6, 1996.
Patent Abstracts of Japan, JP-08313182, Matsushita Electric Ind Co Ltd, Published Nov. 29, 1996.
Patent Abstracts of Japan, JP-08099206, Showa Aluminum Corp., Published Apr. 16, 1996.
Patent Abstracts of Japan, JP-09113169, Matsushita Refrig Co Ltd, Published May 2, 1997.
European Patent Application No. 07113641.0, Extended European Search Report issued Sep. 12, 2007.
J. Dmochowski et al., "Technology of the Tools for Cutting," WN-T Warszawa 1977, edition No. 2, figure 33 p. 382.
K. Dudik, The Hand-Book of the Turner, WN Warszawa 1975, edition VII, fig. 358 p. 446.
Polish Patent Application No. P-373786, Official Action dated Aug. 29, 2008.

* cited by examiner

METHOD OF FORMING PROTRUSIONS ON THE INNER SURFACE OF A TUBE

CROSS REFERENCE TO RELATED APPLICATIONS

This application is a divisional of U.S. patent application Ser. No. 11/674,334 filed Feb. 13, 2007, which is a divisional of U.S. patent application Ser. No. 10/458,398 filed Jun. 10, 2003, which claims the benefit of U.S. Provisional Patent Application No. 60/378,328 filed Jun. 10, 2002, the entirety of all of which are incorporated herein by reference.

FIELD OF THE INVENTION

This invention relates to a heat transfer tube having protrusions on the inner surface of the tube and a method of and tool for forming the protrusions on the inner surface of the tube.

BACKGROUND OF THE INVENTION

This invention relates to a heat transfer tube having an enhanced inner surface to facilitate heat transfer from one side of the tube to the other. Heat transfer tubes are commonly used in equipment, such as, for example, flooded evaporators, falling film evaporators, spray evaporators, absorption chillers, condensers, direct expansion coolers, and single phase coolers and heaters, used in the refrigeration, chemical, petrochemical, and food-processing industries. A variety of heat transfer mediums may be used in these applications, including, but not limited to, pure water, a water glycol mixture, any type of refrigerant (such as R-22, R-134a, R-123, etc.), ammonia, petrochemical fluids, and other mixtures.

An ideal heat transfer tube would allow heat to flow completely uninhibited from the interior of the tube to the exterior of the tube and vice versa. However, such free flow of heat across the tube is generally thwarted by the resistance to heat transfer. The overall resistance of the tube to heat transfer is calculated by adding the individual resistances from the outside to the inside of the tube or vice versa. To improve the heat transfer efficiency of the tube, tube manufacturers have striven to uncover ways to reduce the overall resistance of the tube. One such way is to enhance the outer surface of the tube, such as by forming fins on the outer surface. As a result of recent advances in enhancing the outer tube surface (see, e.g., U.S. Pat. Nos. 5,697,430 and 5,996,686), only a small part of the overall tube resistance is attributable to the outside of the tube. For example, a typical evaporator tube used in a flooded chiller with an enhanced outer surface but smooth inner surface typically has a 10:1 inner resistance:outer resistance ratio. Ideally, one wants to obtain an inside to outside resistance ratio of 1:1. It becomes all the more important, therefore, to develop enhancements to the inner surface of the tube that will significantly reduce the tube side resistance and improve overall heat transfer performance of the tube.

It is known to provide heat transfer tubes with alternating grooves and ridges on their inner surfaces. The grooves and ridges cooperate to enhance turbulence of fluid heat transfer mediums, such as water, delivered within the tube. This turbulence increases the fluid mixing close to the inner tube surface to reduce or virtually eliminate the boundary layer build-up of the fluid medium close to the inner surface of the tube. The boundary layer thermal resistance significantly detracts from heat transfer performance by increasing the heat transfer resistance of the tube. The grooves and ridges also provide extra surface area for additional heat exchange. This basic premise is taught in U.S. Pat. No. 3,847,212 to Withers, Jr. et al.

The pattern, shapes and sizes of the grooves and ridges on the inner tube surface may be changed to further increase heat exchange performance. To that end, tube manufacturers have gone to great expense to experiment with alternative designs, including those disclosed in U.S. Pat. No. 5,791,405 to Takima et al., U.S. Pat. Nos. 5,332,034 and 5,458,191 to Chiang et al., and U.S. Pat. No. 5,975,196 to Gaffaney et al.

In general, however, enhancing the inner surface of the tube has proven much more difficult than the outer surface. Moreover, the majority of enhancements on both the outer and inner surface of tubes are formed by molding and shaping the surfaces. Enhancements have been formed, however, by cutting the tube surfaces.

Japanese Patent Application 09108759 discloses a tool for centering blades that cut a continuous spiral groove directly on the inner surface of a tube. Similarly, Japanese Patent Application 10281676 discloses a tube expanding plug equipped with cutting tools that cut a continuous spiral slot and upstanding fin on the inner surface of a tube. U.S. Pat. No. 3,753,364 discloses forming a continuous groove along the inner surface of a tube using a cutting tool that cuts into the inner tube surface and folds the material upwardly to form the continuous groove.

While all of these inner surface tube designs aim to improve the heat transfer performance of the tube, there remains a need in the industry to continue to improve upon tube designs by modifying existing and creating new designs that enhance heat transfer performance. Additionally, a need also exists to create designs and patterns that can be transferred onto the tubes more quickly and cost-effectively. As described hereinbelow, applicants have developed new geometries for heat transfer tubes as well as tools to form these geometries, and, as a result, have significantly improved heat transfer performance.

SUMMARY OF THE INVENTION

This invention provides an improved heat transfer tube surface and a method of formation thereof that can be used to enhance heat transfer performance of tubes used in at least all of the above-referenced applications (i.e., flooded evaporators, falling film evaporators, spray evaporators, absorption chillers, condensers, direct expansion coolers, and single phase coolers and heaters, used in the refrigeration, chemical, petrochemical, and food-processing industries). The inner surface of the tube is enhanced with a plurality of protrusions that significantly reduce tube side resistance and improve overall heat transfer performance. The protrusions create additional paths for fluid flow within the tube and thereby enhance turbulence of heat transfer mediums flowing within the tube. This increases fluid mixing to reduce the boundary layer build-up of the fluid medium close to the inner surface of the tube, such build-up increasing the resistance and thereby impeding heat transfer. The protrusions also provide extra surface area for additional heat exchange. Formation of the protrusions in accordance with this invention can result in the formation of up to five times more surface area along the inner surface of the tube than with simple ridges. Tests show that the performance of tubes having the protrusions of this invention is significantly enhanced.

The method of this invention includes using a tool, which can easily be added to existing manufacturing equipment, having a cutting edge to cut through ridges on the inner surface of the tube to create ridge layers and a lifting edge to lift the ridge layers to form the protrusions. In this way, the protrusions are formed without removal of metal from the inner surface of the tube, thereby eliminating debris which can damage the equipment in which the tubes are used. The protrusions on the inner surface of the tube can be formed in the same or a different operation as formation of the ridges.

Tubes formed in accordance with this application may be suitable in any number of applications, including, for example, applications for use in the HVAC, refrigeration, chemical, petrochemical, and food-processing industries. The physical geometries of the protrusions may be changed to tailor the tube to a particular application and fluid medium.

It is an object of this invention to provide improved heat transfer tubes.

It is another object of this invention to provide an improved heat transfer tube having protrusions on its inner surface.

It is yet another object of this invention to provide a method of forming an improved heat transfer tube having protrusions on its inner surface.

It is a further object of this invention to provide an innovative tool for forming improved heat transfer tubes.

It is a still further object of this invention to provide a tool for forming protrusions on the inner surface of heat transfer tubes.

These and other features, objects and advantages of this invention will become apparent by reading the following detailed description of preferred embodiments, taken in conjunction with the drawings.

BRIEF DESCRIPTION OF THE DRAWINGS

FIG. 1*b* is a side elevation view of the tube shown in FIG. 1*a* in the direction of arrow a.

DETAILED DESCRIPTION OF THE DRAWINGS

Figure 1A:
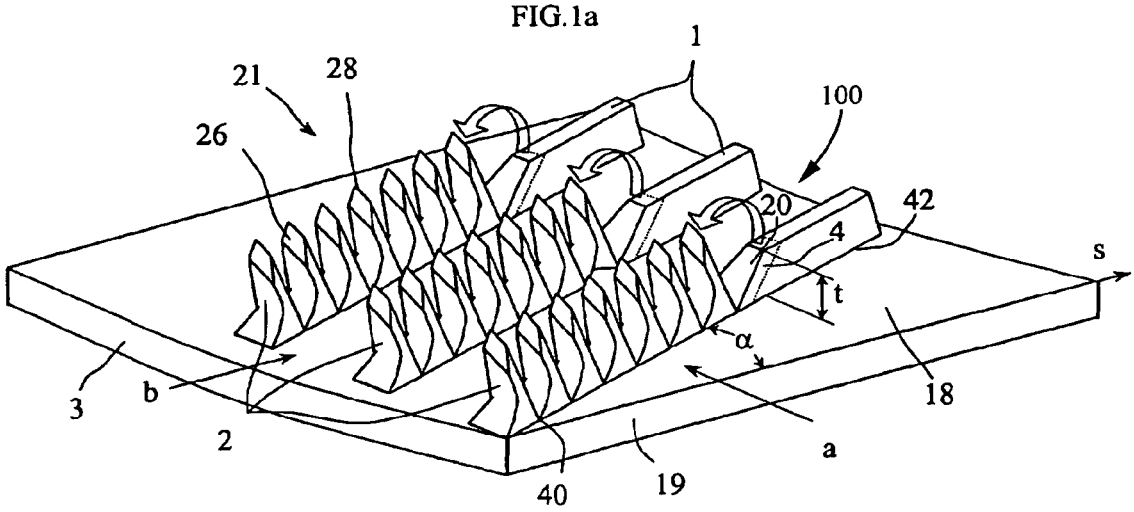
FIG. 1*a* is a fragmentary perspective view of the partially-formed inner surface of one embodiment of a tube of this invention.

FIGS. 1*a-e* show the partially-formed inner surface 18 of one embodiment of the tube 21 of this invention. Inner surface 18 includes a plurality of protrusions 2. Protrusions 2 are formed from ridges 1 formed on inner surface 18 with primary grooves 100 extending between adjacent ridges 1. Ridges 1 are first formed on inner surface 18. The ridges 1 are then cut to create ridge layers 4, which are subsequently lifted up to form protrusions 2 (best seen in FIGS. 1*a* and 1*b*). This cutting and lifting can be, but does not have to be, accomplished using tool 13, shown in FIGS. 6*a-d* and 7*a-d* and described below.

It should be understood that a tube in accordance with this invention is generally useful in, but not limited to, any application where heat needs to be transferred from one side of the tube to the other side of the tube, such as in single-phase and multi-phase (both pure liquids or gases or liquid/gas mixtures) evaporators and condensers. While the following discussion provides desirable dimensions for a tube of this invention, the tubes of this invention are in no way intended to be limited to those dimensions. Rather, the desirable geometries of the tube, including protrusions 2, will depend on many factors, not the least important of which are the properties of the fluid flowing through the tube. One skilled in the art would understand how to alter the geometry of the inner surface of the tube, including the geometry of ridges 1 and protrusion 2, to maximize the heat transfer of the tube used in various applications and with various fluids.

Figure 1B:
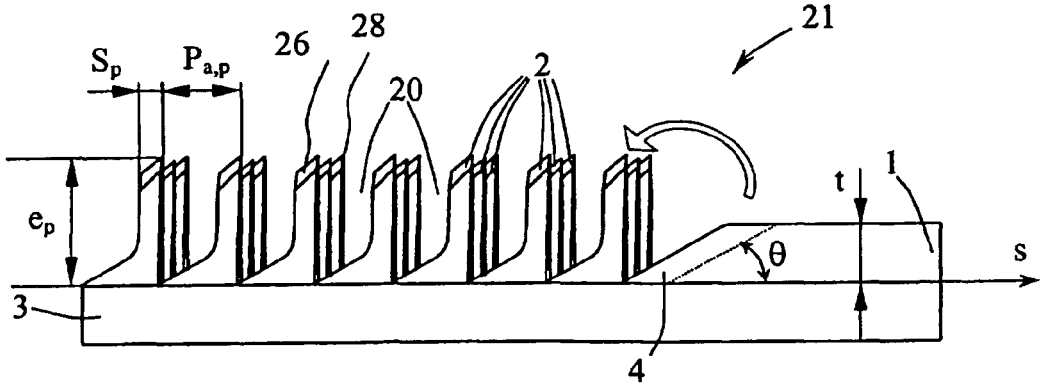
Figure 1C:
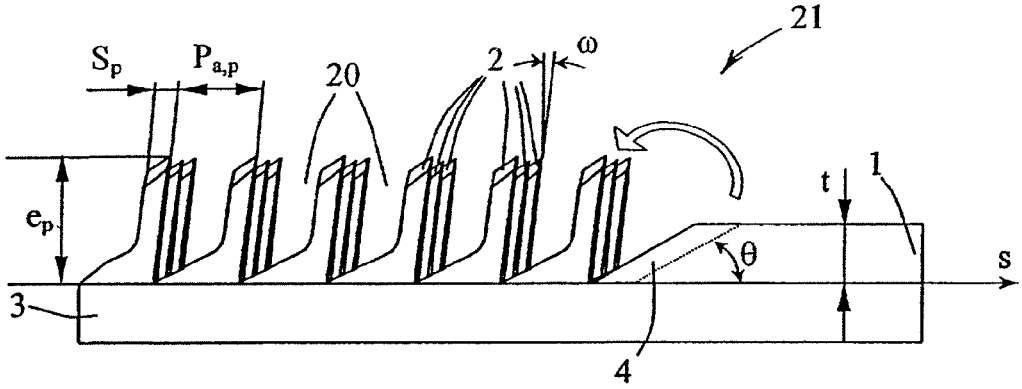
FIG. 1*c* is a side elevation view similar to FIG. 1*b* except that the protrusions protrude from the inner surface of the tube in a direction that is not perpendicular to tube axis s.
Figure 1D:
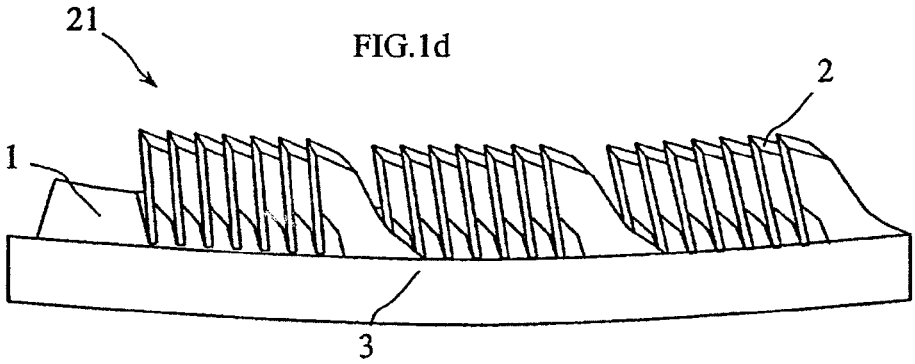
FIG. 1*d* is a front elevation view of the tube shown in FIG. 1*a* in the direction of arrow b.
Figure 1E:
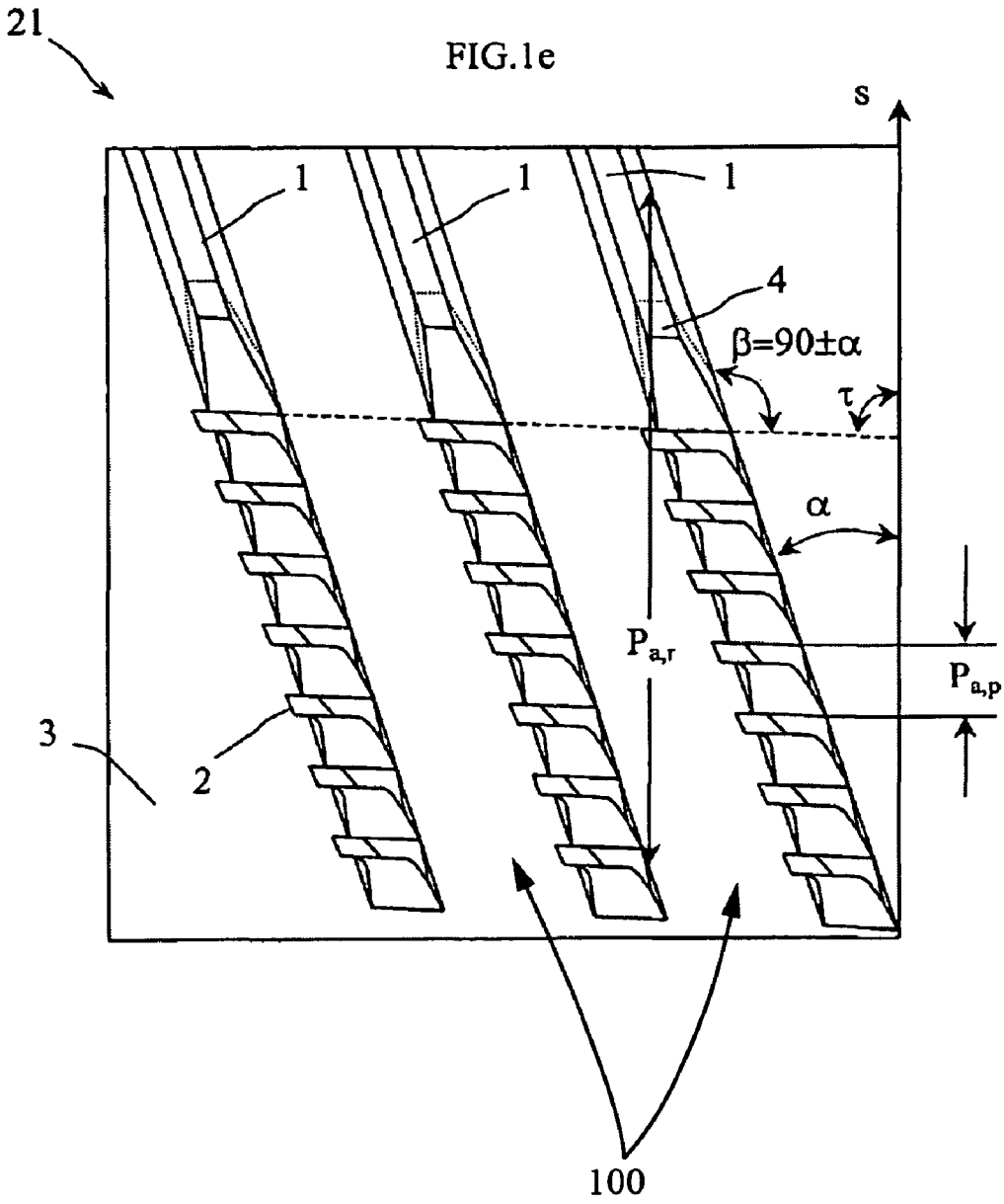
FIG. 1*e* is a top plan view of the tube shown in FIG. 1*a*.
Figure 2:
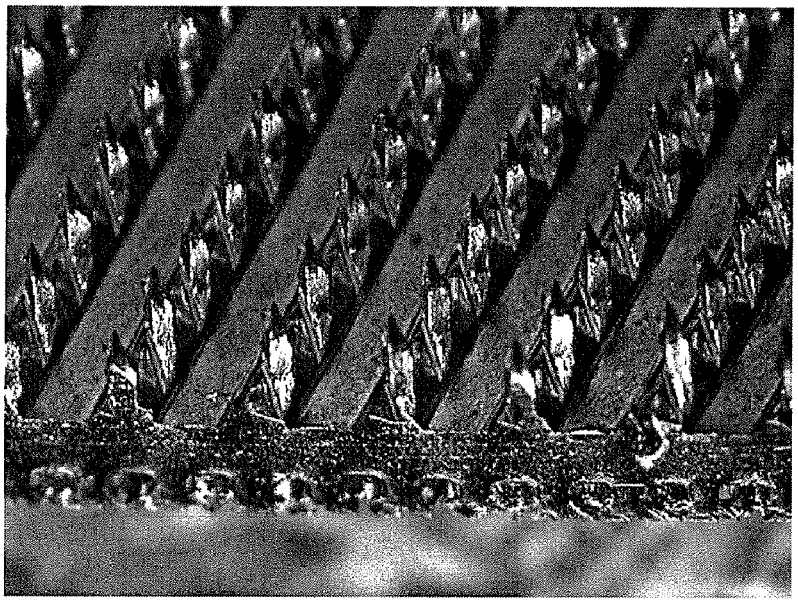
FIG. 2 is a photomicrograph of an inner surface of one embodiment of a tube of this invention.
Figure 3:
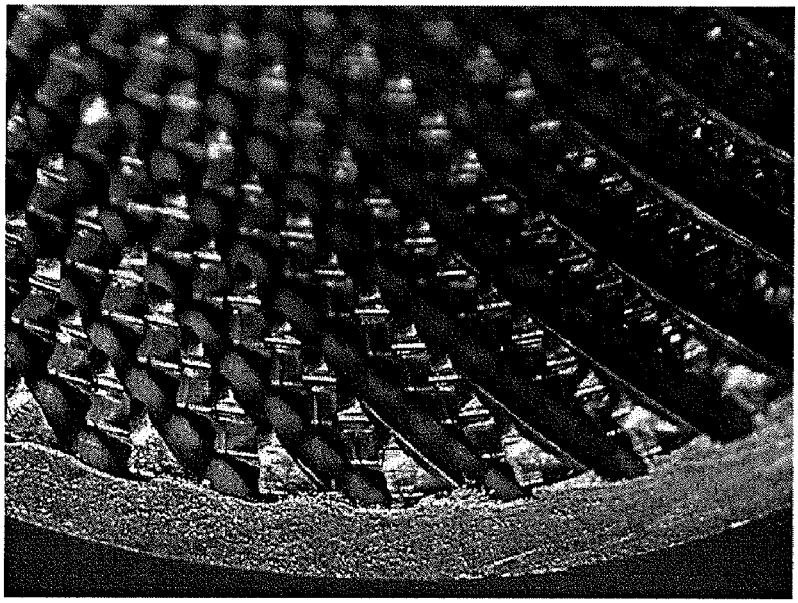
FIG. 3 is a photomicrograph of an inner surface of an alternative embodiment of a tube of this invention.

Ridges 1 are formed on inner surface 18 at a helix angle $\alpha$ to the axis s of the tube (see FIGS. 1*a* and 1*e*). Helix angle $\alpha$ may be any angle between 0°-90°, but preferably does not exceed 70°. One skilled in the art will readily understand that the preferred helix angle $\alpha$ will often depend, at least in part, on the fluid medium used. The height $e_r$ of ridges 1 should generally be greater the more viscous the liquid flowing through tube 21. For example, a height $e_r$ of greater than zero (preferably, but not necessarily, at least 0.001 inches) up to 25% of the inside diameter of the tube ($D_i$) will generally be desirable in a tube sample used with a water/glycol mixture for low temperature applications. For purposes of this application, $D_i$ is the inside diameter of tube 21 measured from inner surface 18 of tube 21. The axial pitch $P_{a,r}$ of ridges 1 depends on many factors, including helix angle α, the number of ridges 1 formed on inner surface 18 of tube 21, and the inside diameter $D_i$ of tube 21. While any pitch $P_{a,r}$ may be used, the ratio of $P_{a,r}/e_r$ is preferably at least 0.002, and the ratio of $e_r/D_i$ is preferably between approximately 0.001-0.25. Again, however, one skilled in the art will readily understand that these preferred ratio values will often depend, at least in part, on the fluid medium used and operating conditions (e.g., the temperature of the fluid medium).

Figure 8A:
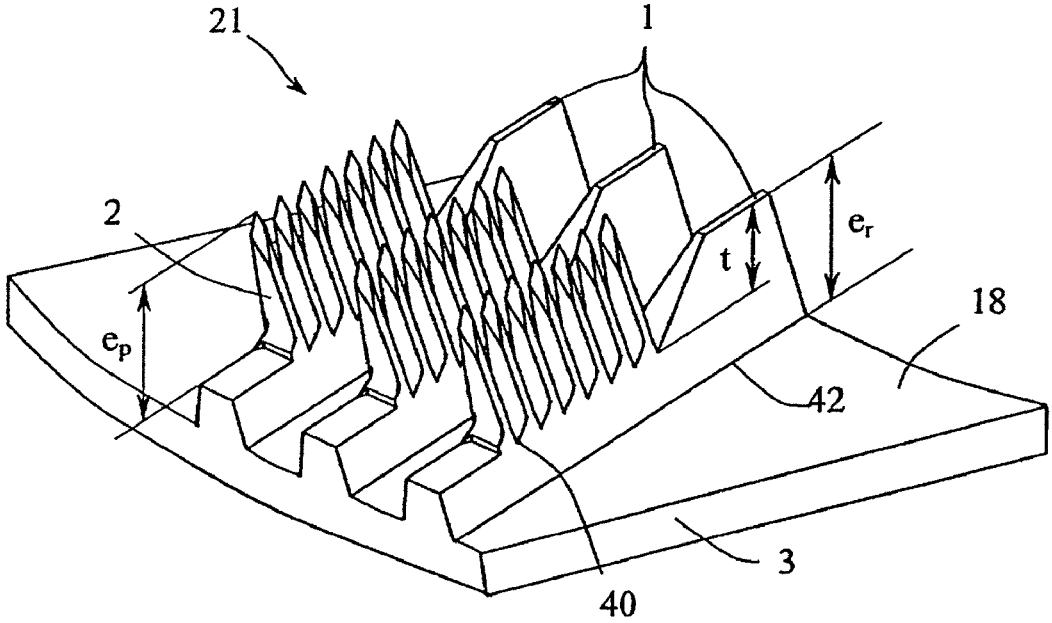
FIG. 8*a* is a fragmentary perspective view of the partially-formed inner surface of an alternative embodiment of a tube of this invention where the depth of the cut through the ridges is less than the helical ridge height.
Figure 8B:
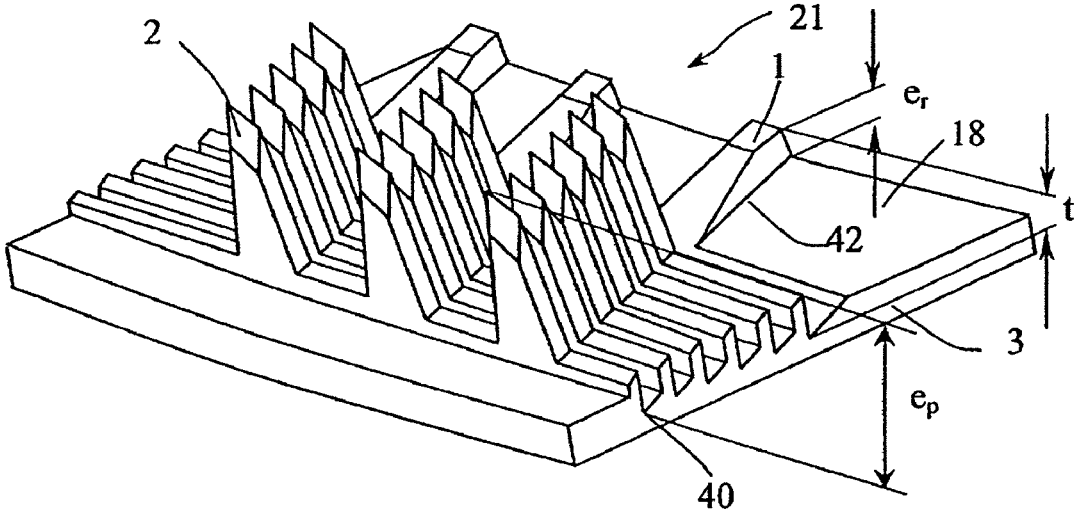
FIG. 8*b* is a fragmentary perspective view of the partially-formed inner surface of an alternative embodiment of a tube of this invention where the depth of the cut through the ridges is greater than the helical ridge height.

Ridge layers 4 are cut at an angle θ to axis s that is preferably between approximately 20°-50°, inclusive, and more preferably around 30°. The axial pitch $P_{a,p}$ of protrusions 2 may be any value greater than zero and generally will depend on, among other factors, the relative revolutions per minute between the tool (discussed below) and the tube during manufacture, the relative axial feed rate between the tool and the tube during manufacture, and the number of tips provided on the tool used to form the protrusions during manufacture. While the resulting protrusions 2 can have any thickness $S_p$, the thickness $S_p$ is preferably approximately 20-100% of pitch $P_{a,p}$. The height $e_p$ of protrusions 2 is dependent on the cutting depth t (as seen in FIGS. 1*b*, 8*a*, and 8*b*) and angle θ at which the ridge layers 4 are cut. The height $e_p$ of protrusions 2 is preferably a value at least as great as the cutting depth t up to three times the cutting depth t. It is preferable, but not necessary, to form ridges 1 at a height $e_r$ and set the cutting angle θ at a value that will result in the height $e_p$ of protrusions 2 being at least approximately double the height $e_r$ of ridges 1. Thus, the ratio of $e_p/D_i$ is preferably between approximately 0.002-0.5 (i.e., $e_p/D_i$ is double the preferred range of the ratio $e_r/D_i$ of approximately 0.001-0.25).

FIGS. 1*a* and 1*b* show cutting depth t equal to the height $e_r$ of ridges 1 so that the base 40 of protrusion 2 is located on the inner surface 18 of tube 21. The cutting depth t need not be equal to the ridge height $e_r$, however. Rather, the ridges 1 can be cut only partially through ridges 1 (see FIG. 8*a*) or beyond the height of ridges 1 and into tube wall 3 (see FIG. 8*b*). In FIG. 8*a*, the ridges 1 are not cut through their entire height $e_r$ so that the base 40 of protrusions 2 is positioned further from the inner surface 18 of tube 21 than the base 42 of ridges 1, which is located on the inner surface 18. In contrast, FIG. 8*b* illustrates a cutting depth t of beyond the ridge height $e_r$, so that at least one wall of the protrusions 2 extends into tube wall 3, beyond the inner surface 18 and ridge base 42.

Figure 11A:
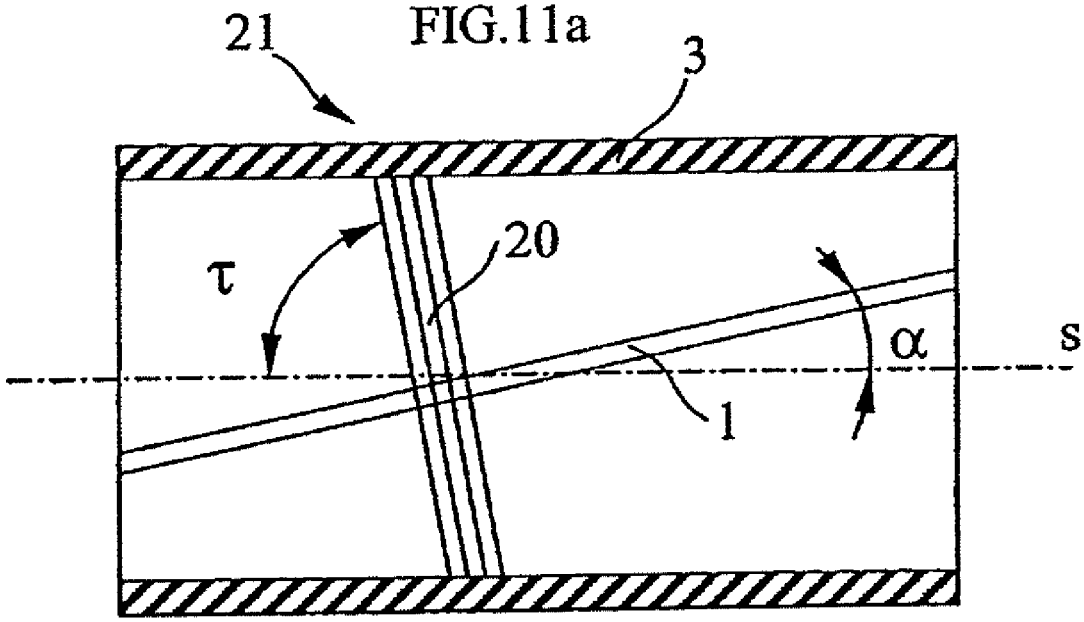
FIG. 11*a* is a schematic of the inner surface of a tube in accordance with this invention showing the angular orientation between the ridges and grooves, whereby the ridges and grooves are opposite hand helix.
Figure 11B:
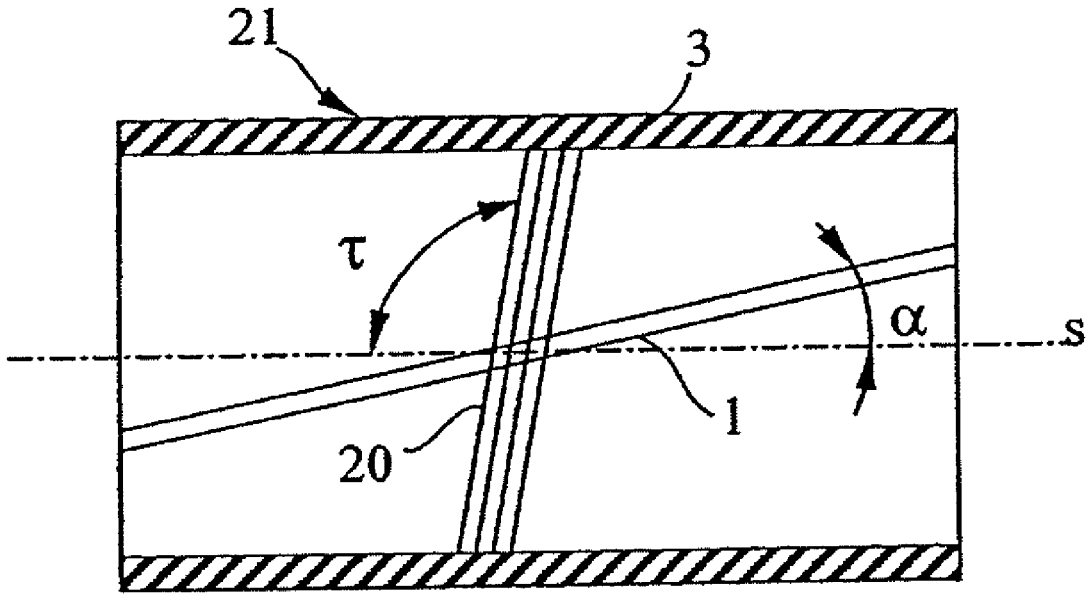
FIG. 11*b* is a schematic of the inner surface of a tube in accordance with this invention showing the angular orientation between the ridges and grooves, whereby the ridges and grooves are same hand helix.

When ridge layers 4 are lifted, secondary grooves 20 are formed between adjacent protrusions 2. Ridge layers 4 are cut and lifted so that secondary grooves 20 are oriented on inner surface 18 at an angle τ to the axis s of tube 21 (see FIGS. 1*e*, 11*a*, and 11*b*), which is preferably, but does not have to be, between approximately 80°-100°.

The shape of protrusions 2 is dependent on the shape of ridges 1 and the orientation of ridges 1 relative to the direction of movement of tool 13. In the embodiment of FIGS. 1*a-e*, protrusions 2 have four side surfaces 25, a sloped top surface 26 (which helps decrease resistance to heat transfer), and a substantially pointed tip 28. The protrusions 2 of this invention are in no way intended to be limited to this illustrated embodiment, however, but rather can be formed in any shape. Moreover, protrusions 2 in tube 21 need not all be the same shape or have the same geometry.

Figure 10A:
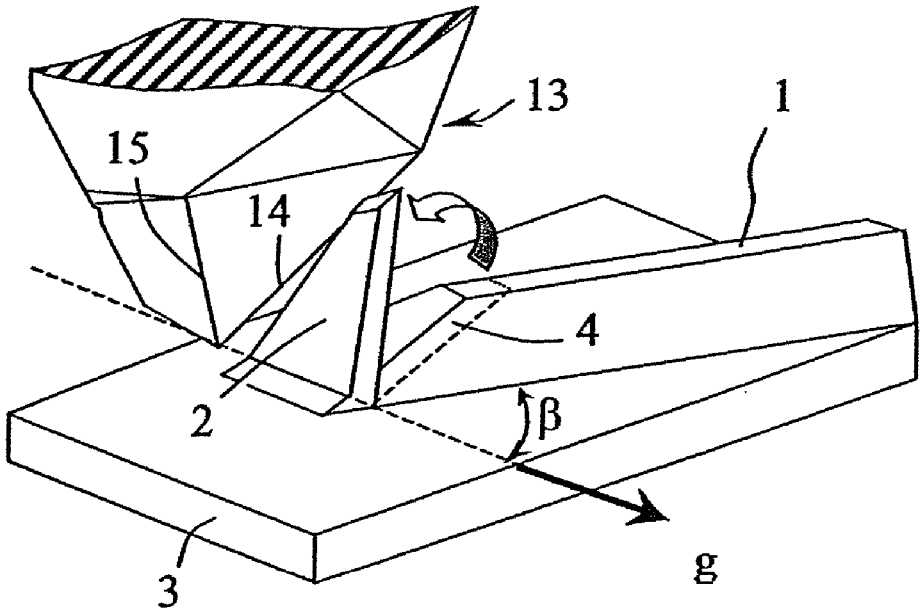
FIG. 10*a* is a fragmentary view of an inner surface of a tube of this invention, showing the tool approaching the ridge in direction g for cutting a protrusion from the ridge in direction g.
Figure 10B:
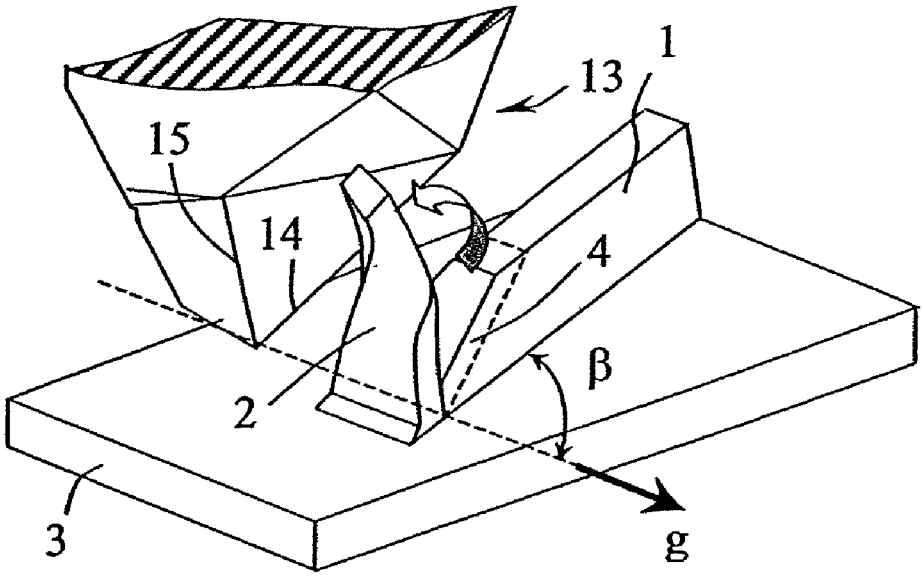
FIG. 10*b* is a fragmentary view of an alternative inner surface of a tube of this invention, showing the tool approaching the ridge in direction g for cutting a protrusion from the ridge in direction g.

Whether the orientation of protrusions 2 is straight (see FIG. 10*a*) or bent or twisted (see FIG. 10*b*) depends on the angle β formed between ridges 1 and the direction of movement g of tool 13. If angle β is less than 90°, protrusions 2 will have a relatively straight orientation, such as is shown in FIG. 10*a*. If angle β is more than 90°, protrusions 2 will have a more bent and/or twisted orientation, such as, for example, is shown in FIG. 10*b*.

During manufacture of tube 21, tool 13 may be used to cut through ridges 1 and lift the resulting ridge layers 4 to form protrusions 2. Other devices and methods for forming protrusions 2 may be used, however. Tool 13 can be made from any material having the structural integrity to withstand metal cutting (e.g. steel, carbide, ceramic, etc.), but is preferably made of a carbide. The embodiments of the tool 13 shown in FIGS. 6*a-d* and 7*a-d* generally have a tool axis q, two base walls 30, 32 and one or more side walls 34. Aperture 16 is located through the tool 13. Tips 12 are formed on side walls 34 of tool 13. Note, however, that the tips can be mounted or formed on any structure that can support the tips in the desired orientation relative to the tube 21 and such structure is not limited to that disclosed in FIGS. 6*a-d* and 7*a-d*. Moreover, the tips may be retractable within their supporting structure so that the number of tips used in the cutting process can easily be varied.

FIGS. 6*a-d* illustrate one embodiment of tool 13 having a single tip 12. FIGS. 7*a-d* illustrate an alternative embodiment of tool 13 having four tips 12. One skilled in the art will understand that tool 13 may be equipped with any number of tips 12 depending on the desired pitch $P_{a,p}$ of protrusions 2. Moreover, the geometry of each tip need not be the same for tips on a single tool 13. Rather, tips 12 having different geometries to form protrusions having different shapes, orientations, and other geometries may be provided on tool 13.

Each tip 12 is formed by the intersection of planes A, B, and C. The intersection of planes A and B form cutting edge 14 that cuts through ridges 1 to form ridge layers 4. Plane B is oriented at an angle ϕ relative to a plane perpendicular to the tool axis q (see FIG. 6*b*). Angle ϕ is defined as 90°−θ. Thus, angle ϕ is preferably between approximately 40°-70° to allow cutting edge 14 to slice through ridges 1 at the desirable angle θ between approximately 20°-50°.

The intersection of planes A and C form lifting edge 15 that lifts ridge layers 4 upwardly to form protrusions 2. Angle $\phi_1$, defined by plane C and a plane perpendicular to tool axis q, determines the angle of inclination ω (the angle between a plane perpendicular to the longitudinal axis s of tube 21 and the longitudinal axis of protrusions 2 (see FIG. 1*c*)) at which protrusions 2 are lifted by lifting edge 15. Angle $\Phi_1$=angle ω, and thus angle $\phi_1$ on tool 13 can be adjusted to directly impact the angle of inclination ω of protrusions 2. The angle of inclination ω (and angle $\phi_1$) is preferably the absolute value of any angle between approximately −45° to 45° relative to the plane perpendicular to the longitudinal axis s of tube 21. In this way, protrusions can be aligned with the plane perpendicular to the longitudinal axis s of tube 21 (see FIG. 1*b*) or incline to the left and right relative to the plane perpendicular to the longitudinal axis s of tube 21 (see FIG. 1*c*). Moreover, the tips 12 can be formed to have different geometries (i.e., angle $\phi_1$ may be different on different tips), and thus the protrusions 2 within tube 21 may incline at different angles (or not at all) and in different directions relative to the plane perpendicular to the longitudinal axis s of tube 21.

While preferred ranges of values for the physical dimensions of protrusions 2 have been identified, one skilled in the art will recognize that the physical dimensions of tool 13 may be modified to impact the physical dimensions of resulting protrusions 2. For example, the depth t that cutting edge 14 cuts into ridges 1 and angle ϕ affect the height $e_p$ of protrusions 2. Therefore, the height $e_p$ of protrusions 2 may be adjusted using the expression $$e_p = t/\sin(90-\phi)$$

or, given that ϕ=90−θ, $$e_p = t/\sin(\theta)$$

Where:

t is the cutting depth;

ϕ is the angle between plane B and a plane perpendicular to tool axis q; and

θ is the angle at which the ridge layers 4 are cut relative to the longitudinal axis s of the tube 21.

Thickness $S_p$ of protrusions 2 depends on pitch $P_{a,p}$ of protrusions 2 and angle Φ. Therefore, thickness $S_p$ can be adjusted using the expression $$S_p = P_{a,p} \cdot \sin(90-\phi)$$

or, given that ϕ=90−θ, $$S_p = P_{a,p} \cdot \sin(\theta)$$

Where:

$P_{a,p}$ is the axial pitch of protrusions 2;

ϕ is the angle between plane B and a plane perpendicular to tool axis q; and

θ is the angle at which the ridge layers 4 are cut relative to the longitudinal axis s of the tube 21.

Figure 4:
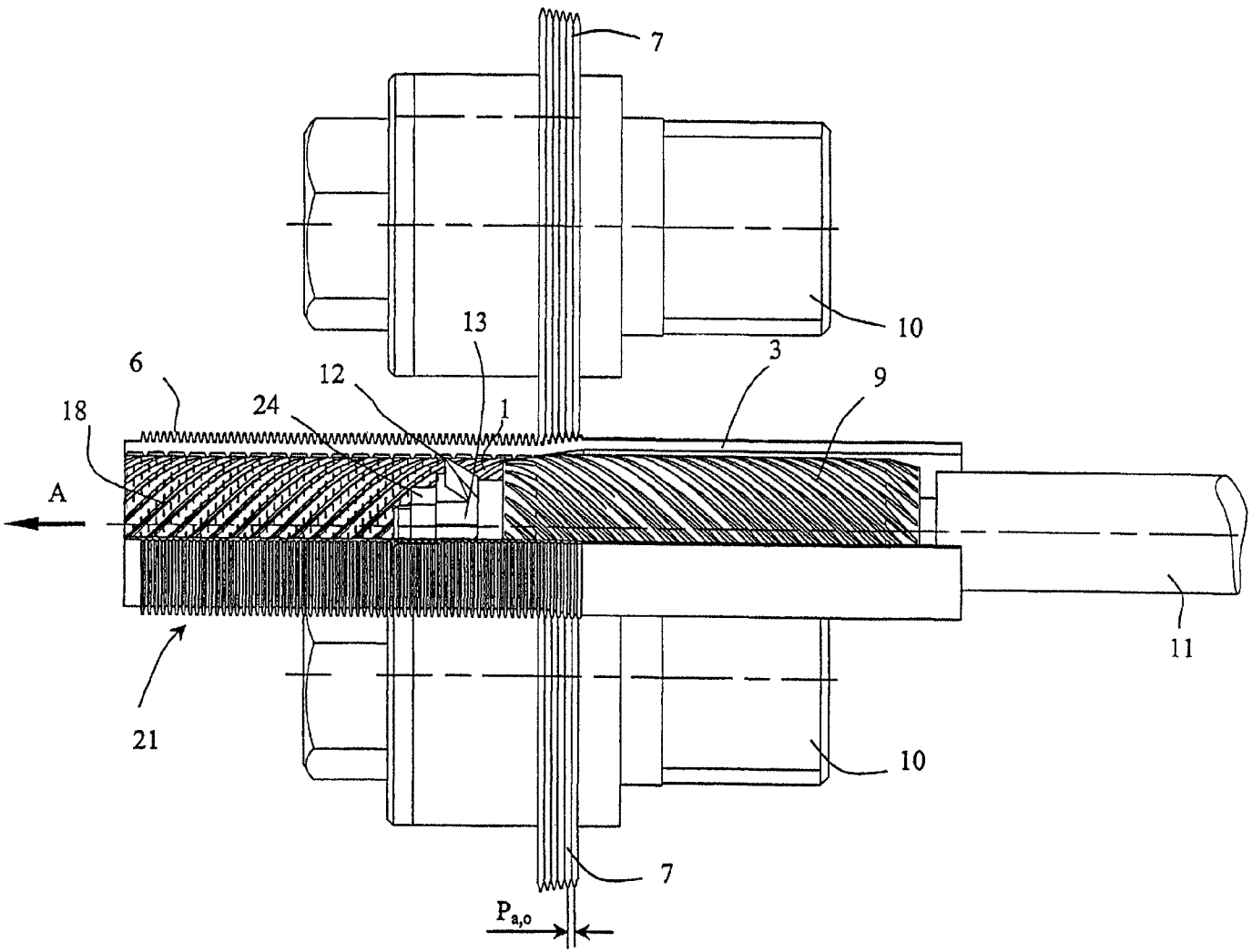
FIG. 4 is a side elevation view of one embodiment of the manufacturing equipment that can be used to produce tubes in accordance with this invention.
Figure 5:
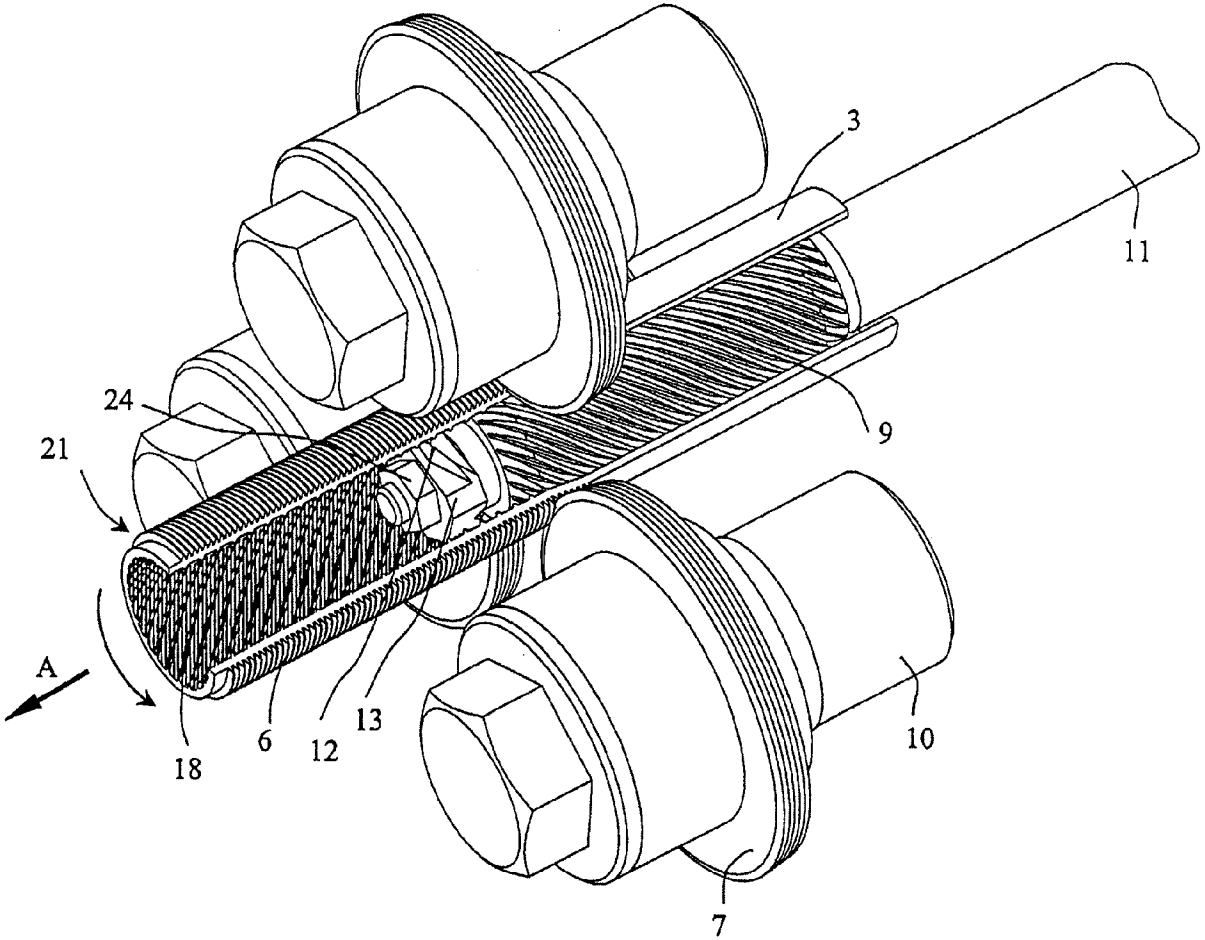
FIG. 5 is a perspective view of the equipment of FIG. 4.

FIGS. 4 and 5 illustrate one possible manufacturing set-up for enhancing the surfaces of tube 21. These figures are in no way intended to limit the process by which tubes in accordance with this invention are manufactured, but rather any tube manufacturing process using any suitable equipment or configuration of equipment may be used. The tubes of this invention may be made from a variety of materials possessing suitable physical properties including structural integrity, malleability, and plasticity, such as, for example, copper and copper alloys, aluminum and aluminum alloys, brass, titanium, steel, and stainless steel. FIGS. 4 and 5 illustrate three arbors 10 operating on tube 21 to enhance the outer surface of tube 21. Note that one of the arbors 10 has been omitted from FIG. 4. Each arbor 10 includes a tool set-up having finning disks 7 which radially extrude from one to multiple start outside fins 6 having axial pitch $P_{a,o}$. The tool set-up may include additional disks, such as notching or flattening disks, to further enhance the outer surface of tube 21. Moreover, while only three arbors 10 are shown, fewer or more arbors may be used depending on the desired outer surface enhancements. Note, however, that depending on the tube application, enhancements need not be provided on the outer surface of tube 21 at all.

Figure 6A:
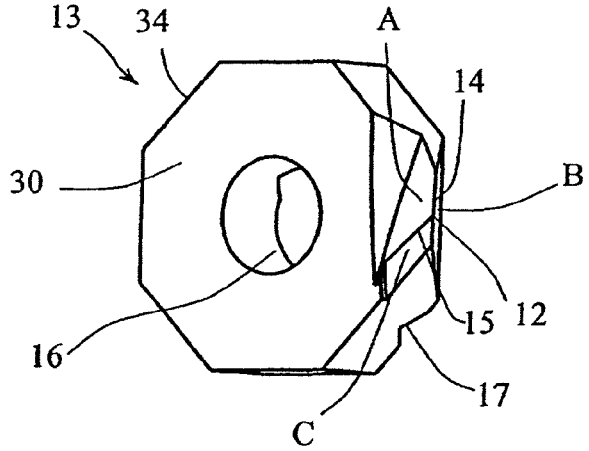
FIG. 6*a* is a perspective view of one embodiment of the tool of this invention.
Figure 6B:
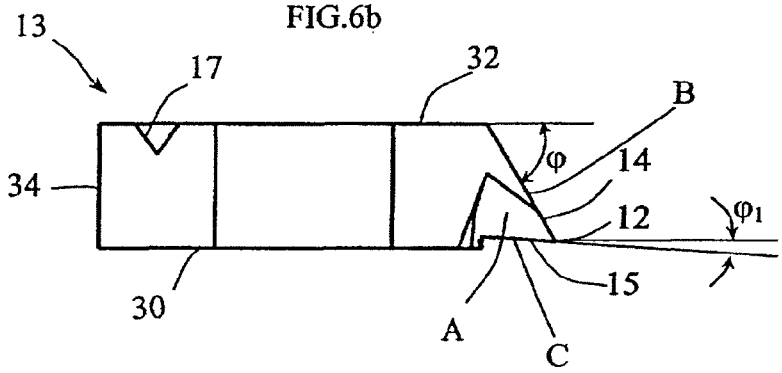
FIG. 6*b* is a side elevation view of the tool shown in FIG. 6*a*.
Figure 6C:
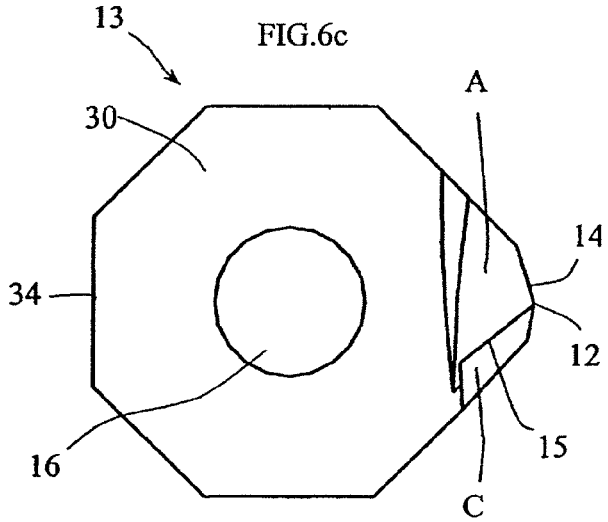
FIG. 6*c* is a bottom plan view of the tool of FIG. 6*b*.
Figure 6D:
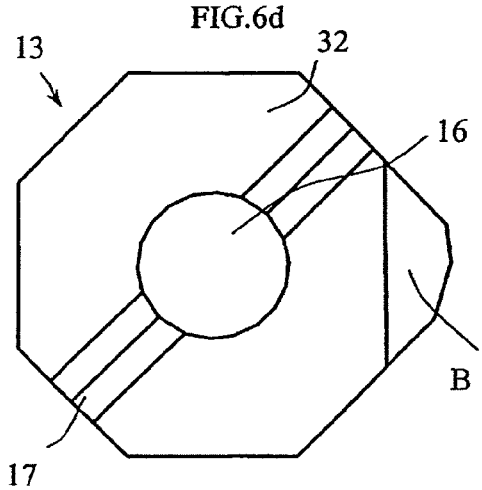
FIG. 6*d* is a top plan view of the tool of FIG. 6*b*.
Figure 7A:
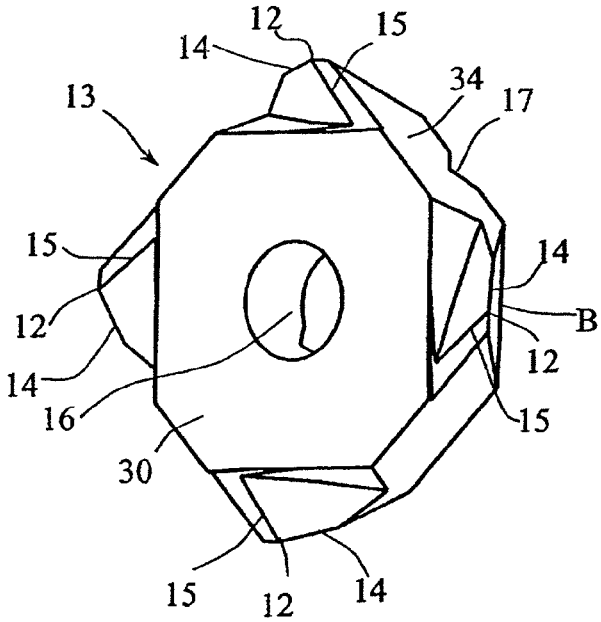
FIG. 7*a* is a perspective view of an alternative embodiment of the tool of this invention.
Figure 7B:
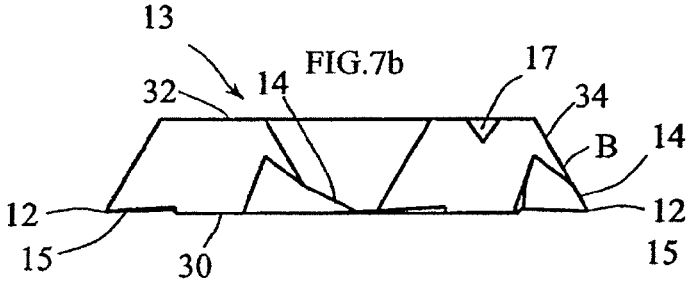
FIG. 7*b* is a side elevation view of the tool shown in FIG. 7*a*.
Figure 7C:
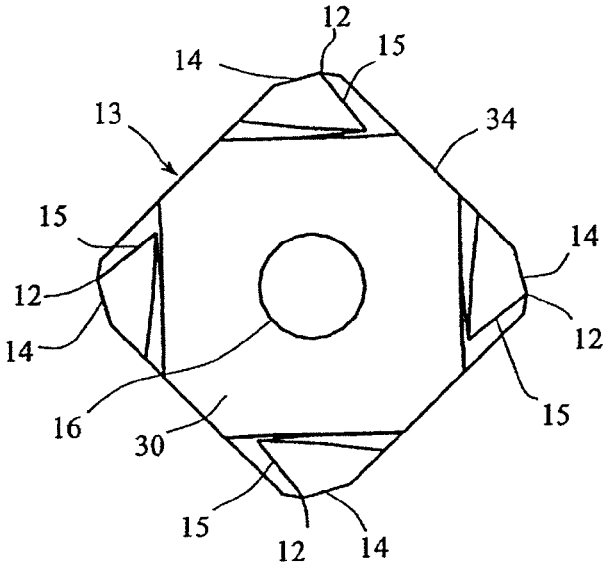
FIG. 7*c* is a bottom plan view of the tool of FIG. 7*b*.
Figure 7D:
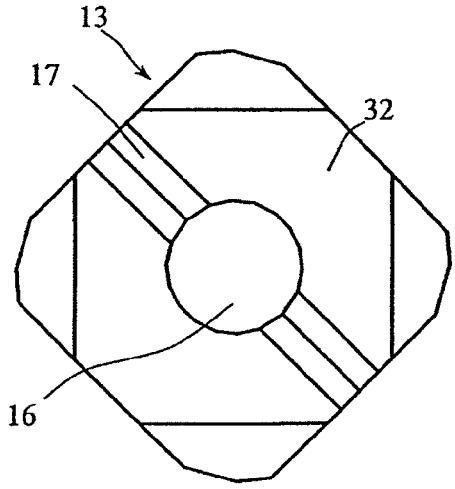
FIG. 7*d* is a top plan view of the tool of FIG. 7*b*.

In one example of a way to enhance inner surface 18 of tube 21, a mandrel shaft 11 onto which mandrel 9 is rotatably mounted extends into tube 21. Tool 13 is mounted onto shaft 11 through aperture 16. Bolt 24 secures tool 13 in place. Tool 13 is preferably locked in rotation with shaft 11 by any suitable means. FIGS. 6*d* and 7*d* illustrate a key groove 17 that may be provided on tool 13 to interlock with a protrusion on shaft 11 (not shown) to fix tool 13 in place relative to shaft 11.

In operation, tube 21 generally rotates as it moves through the manufacturing process. Tube wall 3 moves between mandrel 9 and finning disks 7, which exert pressure on tube wall 3. Under pressure, the metal of tube wall 3 flows into the grooves between the finning disks 7 to form fins 6 on the exterior surface of tube 21.

The mirror image of a desired inner surface pattern is provided on mandrel 9 so that mandrel 9 will form inner surface 18 of tube 21 with the desired pattern as tube 21 engages mandrel 9. A desirable inner surface pattern includes ridges 1, as shown in FIGS. 1*a* and 4. After formation of ridges 1 on inner surface 18 of tube 21, tube 21 encounters tool 13 positioned adjacent and downstream mandrel 9. As explained previously, the cutting edge(s) 14 of tool 13 cuts through ridges 1 to form ridge layers 4. Lifting edge(s) 15 of tool 13 then lift ridge layers 4 to form protrusions 2.

When protrusions 2 are formed simultaneously with outside finning and tool 13 is fixed (i.e., not rotating or moving axially), tube 21 automatically rotates and has an axial movement. In this instance, the axial pitch of protrusions $P_{a,p}$ is governed by the following formula:

$$P_{a,p} = \frac{P_{a,o} \cdot Z_o}{Z_i}$$

Where:

$P_{a,o}$ is the axial pitch of outside fins 6;

$Z_o$ is the number of fin starts on the outer diameter of tube 21; and $Z_i$ is the number of tips 12 on tool 13.

To obtain a specific protrusion axial pitch $P_{a,p}$, tool 13 can also be rotated. Both tube 21 and tool 13 can rotate in the same direction or, alternatively, both tube 21 and tool 13 can rotate, but in opposite directions. To obtain a predetermined axial protrusion pitch $P_{a,p}$, the necessary rotation (in revolutions per minute (RPM)) of the tool 13 can be calculated using the following formula:

$$RPM_{tool} = \frac{RPM_{tube}(P_{a,o} \cdot Z_o - P_{a,p} \cdot Z_i)}{Z_i \cdot P_{a,p}}$$

Where:

$RPM_{tube}$ is the frequency of rotation of tube 21;

$P_{a,o}$ is the axial pitch of outer fins 6;

$Z_o$ is the number of fin starts on the outer diameter of tube 21;

$P_{a,p}$ is the desirable axial pitch of protrusions 2; and $Z_i$ is the number of tips 12 on tool 13.

If the result of this calculation is negative, then tool 13 should rotate in the same direction of tube 21 to obtain the desired pitch $P_{a,p}$. Alternatively, if the result of this calculation is positive, then tool 13 should rotate in the opposite direction of tube 21 to obtain the desired pitch $P_{a,p}$.

Note that while formation of protrusions 2 is shown in the same operation as formation of ridges 1, protrusions 2 may be produced in a separate operation from finning using a tube with pre-formed inner ridges 1. This would generally require an assembly to rotate tool 13 or tube 21 and to move tool 13 or tube 21 along the tube axis. Moreover, a support is preferably provided to center tool 13 relative to the inner tube surface 18.

In this case, the axial pitch $P_{a,p}$ of protrusions 2 is governed by the following formula:

$$P_{a,p} = X_a/(\mathrm{RPM} \cdot Z_i)$$

Where:

$X_a$ is the relative axial speed between tube 21 and tool 13 (distance/time);

RMP is the relative frequency of rotation between tool 13 and tube 21;

$P_{a,p}$ is the desirable axial pitch of protrusions 2; and $Z_i$ is the number of tips 12 on tool 13.

This formula is suitable when (1) the tube moves only axially (i.e., does not rotate) and the tool only rotates (i.e., does not move axially); (2) the tube only rotates and the tool moves only axially; (3) the tool rotates and moves axially but the tube is both rotationally and axially fixed; (4) the tube rotates and moves axially but the tool is both rotationally and axially fixed; and (5) any combination of the above.

Figure 9A:
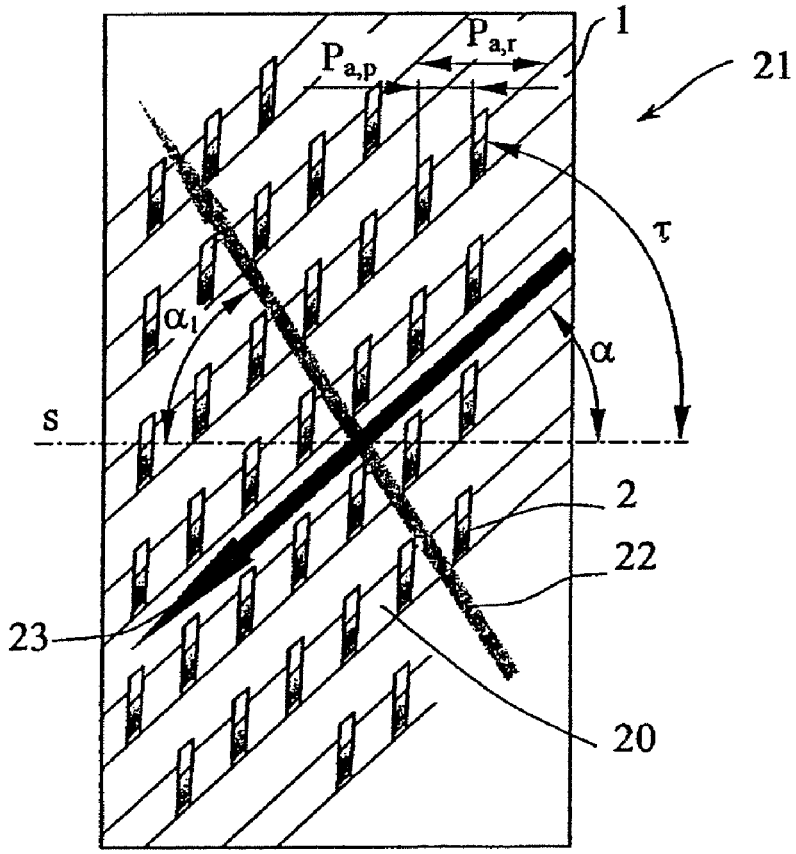
FIG. 9*a* is a fragmentary top plan view of the inner surface of another embodiment of a tube in accordance with this invention.
Figure 9B:
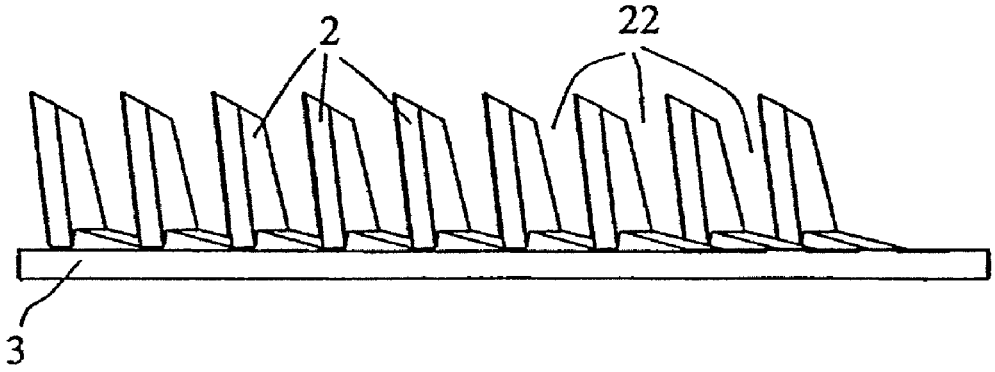
FIG. 9*b* is an elevation view of the tube shown in FIG. 9*a* in the direction of arrow 22.

With the inner tube surface of this invention, additional paths for fluid flow are created (between protrusions 2 through secondary grooves 20) to optimize heat transfer and pressure drop. FIG. 9*a* illustrates these additional paths 22 for fluid travel through tube 21. These paths 22 are in addition to fluid flow paths 23 created between ridges 1. These additional paths 22 have a helix angel $\alpha_1$ relative to the tube axis s. Angle $\alpha_1$ is the angle between protrusions 2 formed from adjacent ridges 1. FIG. 9*b* clearly shows these additional paths 22 formed between protrusions 2. Helix angle $\alpha_1$, and thus orientation of paths 22 through tube 21, can be adjusted by adjusting pitch $P_{a,p}$ of protrusions 2 using the following expression $$P_{a,p} = \frac{P_{a,r} \cdot \tan(\alpha) \cdot \pi D_i}{\pi D_i \cdot (\tan(\alpha) + \tan(\alpha_1)) \pm P_{a,r} \cdot \tan(\alpha) \cdot \tan(\alpha_1) \cdot Z_i}$$

Where:

$P_{a,r}$ is the axial pitch of ridges 1;

$\alpha$ is the angle of ridges 1 to tube axis s;

$\alpha_1$ is the desirable helix angle between protrusions 2;

$Z_i$ is the number of tips 12 on tool 13; and $D_i$ is the inside diameter of tube 21 measured from inner surface 18 of tube 21.

If ridge helix angle $\alpha$ and angle $\tau$ of secondary grooves 20 are both either right hand or left hand helix (see FIG. 11*b*), then the "[−]" should be used in the above expression. Alternatively, if ridge helix angle $\alpha$ and angle $\tau$ of secondary grooves 20 are opposite hand helix (see FIG. 11*a*), then the "[+]" should be used in the above expression.

Figure 12:
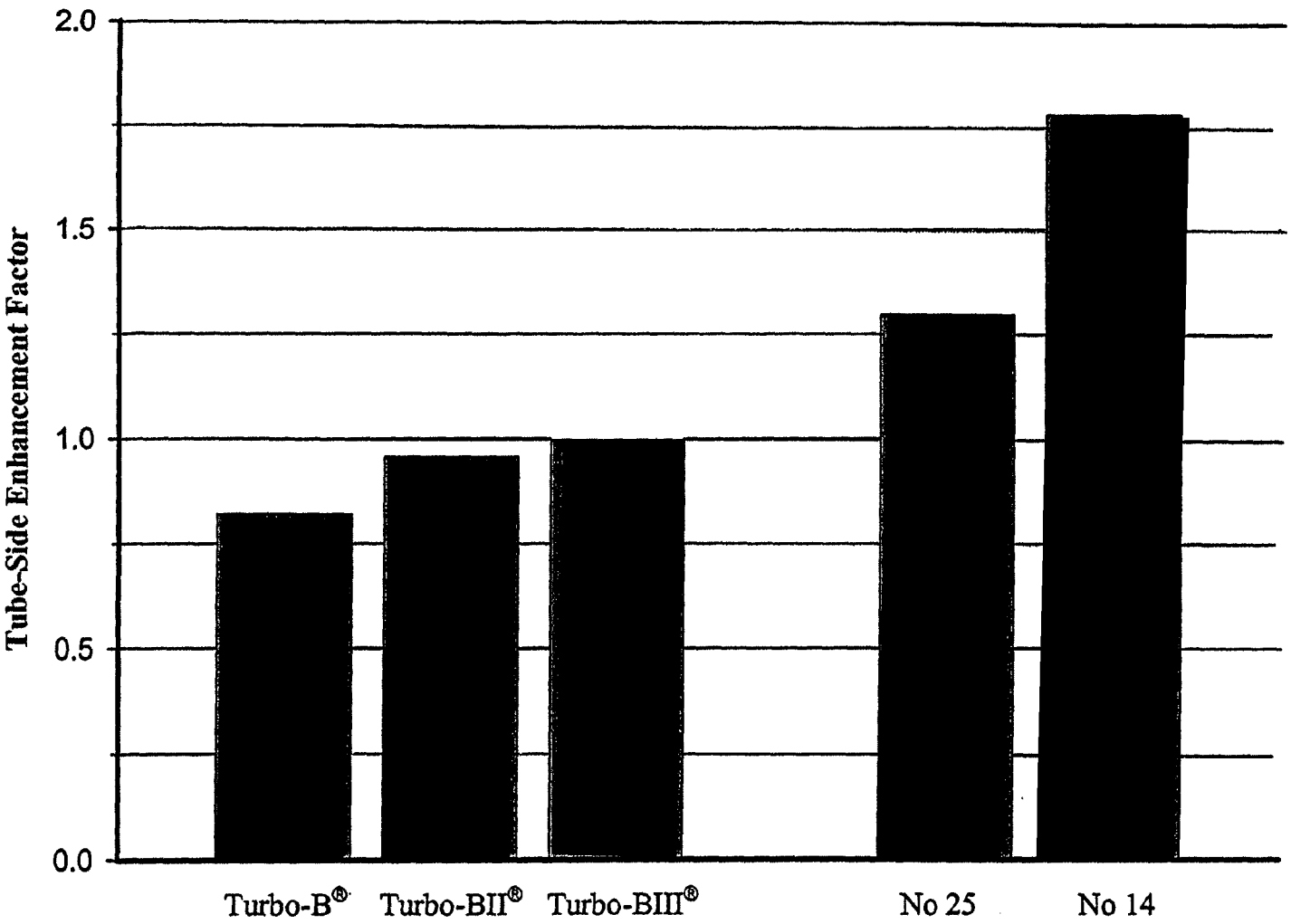
FIG. 12 is a bar graph comparing the tube-side heat transfer coefficients of various tubes of the prior art and of tubes in accordance with this invention.
Figure 13:
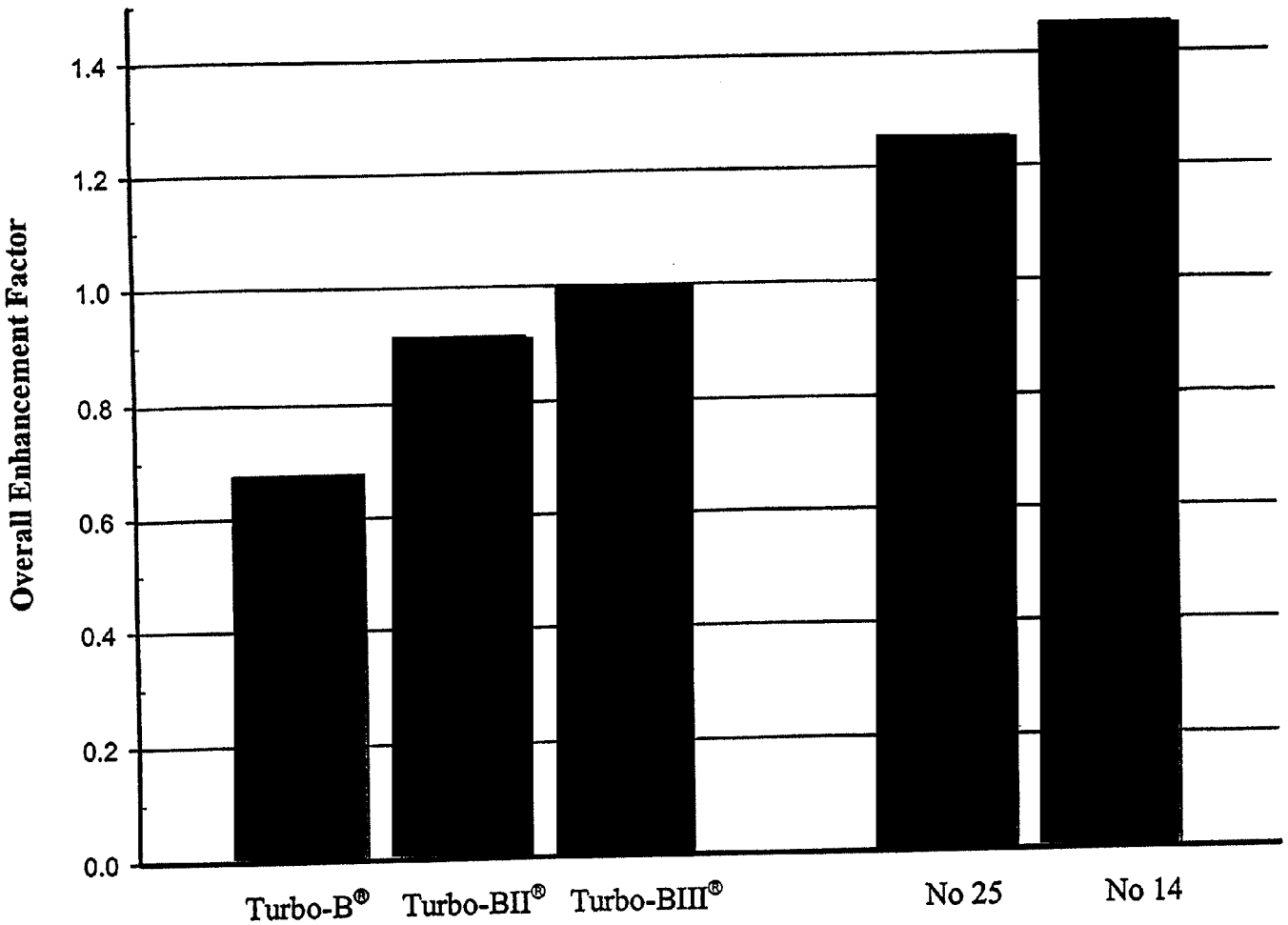
FIG. 13 is bar graph comparing the overall heat transfer coefficients of various tubes of the prior art and of tubes in accordance with this invention.

Tubes made in accordance with this invention outperform existing tubes. FIGS. 12 and 13 graphically illustrate the enhanced performance of two examples of such tubes (boiling tubes Tube No. 25 and Tube No. 14) by demonstrating the differences in the enhancement factors between these tubes. The enhancement factor is the factor by which the heat transfer coefficients (both tube-side (see FIG. 12) and overall (see FIG. 13)) of these new tubes (Tube No. 25 and Tube No. 14) increase over existing tubes (Turbo-B®, Turbo-BII®, and Turbo B-III®). Again, however, Tube Nos. 25 and 14 are merely examples of tubes in accordance with this invention. Other types of tubes made in accordance with this invention outperform existing tubes in a variety of applications.

The physical characteristics of the Turbo-B®, Turbo-BII®, and Turbo B-III® tubes are described in Tables 1 and 2 of U.S. Pat. No. 5,697,430 to Thors, et al. Turbo-B® is referenced as Tube II; Turbo-BII® is referenced as Tube III; and Turbo B-III® is referenced as Tube $IV_H$. The outside surfaces of Tube No. 25 and Tube No. 14 are identical to that of Turbo B-III®. The inside surfaces of Tube No. 25 and Tube No. 14 are in accordance with this invention and include the following physical characteristics:

TABLE 1

Tube and Ridge Dimensions

| | Tube No. 25 | Tube No. 14 |
|---|---|---|
| Outside Diameter of Tube (inches) | 0.750 | 0.750 |
| Inside Diameter of Tube $D_i$ (inches) | 0.645 | 0.650 |
| Number of Inner Ridges | 85 | 34 |
| Helix Angle $\alpha$ of Inner Ridges (degrees) | 20 | 49 |
| Inner Ridge Height $e_r$ (inches) | 0.0085 | 0.016 |
| Inner Ridge Axial Pitch $P_{a,r}$ (inches) | 0.065 | 0.052 |
| $P_{a,r}/e_r$ | 7.65 | 3.25 |
| $e_r/D_i$ | 0.0132 | 0.025 |

TABLE 2

Protrusion Dimensions

| | Tube No. 25 | Tube No. 14 |
|---|---|---|
| Protrusion Height $e_p$ (inches) | 0.014 | 0.030 |
| Protrusion Axial Pitch $P_{a,p}$ (inches) | 0.0167 | 0.0144 |
| Protrusion Thickness $S_p$ (inches) | 0.0083 | 0.007 |
| Depth of Cut into Ridge t (inches) | 0.007 | 0.015 |

Moreover, the tool used to form the protrusions on Tube Nos. 25 and 14 had the following characteristics:

TABLE 3

Tool Dimensions

| | Tube No. 25 | Tube No. 14 |
|---|---|---|
| Number of Cutting Tips $Z_i$ | 3 | 1 |
| Angle $\phi$ (degrees) | 60° | 60° |
| Angle $\omega$ (degrees) | 2° | 2° |
| Angle $\tau$ (degrees) | 89.5° | 89.6° |
| Angle $\beta$ (degrees) | 69.5° | 40.6° |
| Number of Outside Diameter Fin Starts | 3 | N/A |
| Tool Revolution per Minute | 0 | 1014 |
| Tube Revolution per Minute | 1924 | 0 |
| $X_a$ (inches/minute) | 96.2 | 14.7 |

FIG. 12 shows that the tube-side heat transfer coefficient of Tube No. 14 is approximately 1.8 times and Tube No. 25 is approximately 1.3 times that of Turbo B-III®, which is currently the most popular tube used in evaporator applications and shown as a baseline in FIGS. 12 and 13. Similarly, FIG. 13 shows that the overall heat transfer coefficient of Tube No. 25 is approximately 1.25 times and Tube No. 14 is approximately 1.5 times that of Turbo B-III®.

The foregoing is provided for purposes of illustrating, explaining, and describing embodiments of this invention. Further modifications and adaptations to these embodiments will be apparent to those skilled in the art and may be made without departing from the scope or spirit of the invention.

We claim:

1. A method of manufacturing a tube having a surface, a longitudinal axis, ridges extending along the tube surface, and a plurality of primary grooves each extending along the tube surface between adjacent ridges, the method comprising:

a. cutting through at least one ridge to a cutting depth and at an angle relative to the longitudinal axis to form ridge layers; and b. lifting the ridge layers upwardly relative to the surface of the tube to form (i) a plurality of protrusions along the at least one ridge and (ii) secondary grooves extending between and connecting adjacent primary grooves between which the at least one ridge extends, wherein at least some of the plurality of protrusions project from the surface in a direction that is not substantially perpendicular to the longitudinal axis.

2. The method of claim 1, wherein the plurality of protrusions are formed on the inner surface of the tube.

3. The method of claim 1, wherein each of the plurality of protrusions has a height that is a value no more than three times the cutting depth.

4. The method of claim 2, wherein the tube has an inside diameter and each of the plurality of protrusions has a height, wherein the ratio of each protrusion height to tube inside diameter is between approximately 0.002 and 0.5.

5. The method of claim 1, wherein other of the plurality of protrusions extend from the surface in a direction substantially perpendicular to the longitudinal axis.

6. The method of claim 1, wherein the secondary grooves extend at an angle between approximately 80° and 100° relative to the longitudinal axis of the tube.

7. The method of claim 1, wherein the at least one ridge is cut through at an angle between approximately 20° and 50° relative to the longitudinal axis of the tube.

8. The method of claim 1, wherein the at least one ridge has a ridge height and the cutting depth approximately equals the ridge height.

9. The method of claim 1, wherein the at least one ridge has a ridge height and the cutting depth does not equal the ridge height.

10. The method of claim 1, wherein at least some of the plurality of protrusions comprise a sloped top surface.

11. The method of claim 1, wherein at least some of the plurality of protrusions comprise a pointed tip.

12. A method of manufacturing a tube having a surface and a longitudinal axis comprising using a tool having at least one tool tip (i) to cut with the at least one tool tip through at least one ridge formed along the surface of the tube to a cutting depth and at an angle relative to the longitudinal axis to form ridge layers and (ii) to lift with the at least one tool tip the ridge layers upwardly relative to the surface of the tube to form a plurality of protrusions along the at least one ridge and secondary grooves extending between and connecting adjacent primary grooves between which the at least one ridge extends, wherein at least some of the plurality of protrusions project from the surface in a direction that is not substantially perpendicular to the longitudinal axis.

13. The method of claim 12, wherein the tool tip comprises a cutting edge to cut through the at least one ridge and a lifting edge to lift the ridge layers.

14. The method of claim 12, wherein the plurality of protrusions are formed on the inner surface of the tube.

15. The method of claim 12, wherein other of the plurality of protrusions extend from the surface in a direction substantially perpendicular to the longitudinal axis.

16. The method of claim 12, wherein the at least one ridge has a ridge height and the cutting depth approximately equals the ridge height.

17. The method of claim 12, wherein the at least one ridge has a ridge height and the cutting depth does not equal the ridge height.

18. The method of claim 12, wherein at least some of the plurality of protrusions comprise a sloped top surface.

19. The method of claim 12, wherein at least some of the plurality of protrusions comprise a pointed tip.

* * * * *